US005928553A

United States Patent [19]

Toshima et al.

[11] Patent Number: 5,928,553

[45] Date of Patent: Jul. 27, 1999

[54] SEALED BAG FOR MICROWAVE HEATING

[75] Inventors: Isao Toshima, Kanagawa-ken; Shinji Murata; Misao Kishi, both of Saitama-ken, all of Japan

[73] Assignees: Kabushiki Kaisha Hoseki Planning, Tokyo-to; Sanwa Automatic Machinery Co., Ltd., Osaka; Totai Co., Ltd., Tokyo-to, all of Japan

[21] Appl. No.: 09/006,945

[22] Filed: Jan. 14, 1998

[30] Foreign Application Priority Data

Jan. 22, 1997 [JP] Japan ..... 9-021937

[51] Int. Cl.[6] ..... H05B 6/80; B65D 33/22

[52] U.S. Cl. ..... 219/725; 219/727; 219/735; 220/361; 426/118; 426/234; 99/DIG. 14

[58] Field of Search ..... 219/725, 727, 219/734, 735; 220/361, 316; 426/113, 118, 234, 241; 99/DIG. 14

[56] References Cited

U.S. PATENT DOCUMENTS

| | | | |
|---|---|---|---|
| 4,874,620 | 10/1989 | Mendenhall et al. | 426/113 |
| 5,171,950 | 12/1992 | Brauner et al. | 219/735 |
| 5,294,764 | 3/1994 | Mass | 219/727 |
| 5,464,969 | 11/1995 | Miller | 219/735 |

FOREIGN PATENT DOCUMENTS

| | | |
|---|---|---|
| 537108A2 | 4/1993 | Germany . |
| 661219A2 | 7/1995 | Germany . |
| 2666019 | 9/1993 | Japan . |

*Primary Examiner*—Philip H. Leung
*Attorney, Agent, or Firm*—Jordan and Hamburg LLP

[57] ABSTRACT

A sealed bag for microwave heating composed of a film having a fusing layer inside, said bag being sealed by fusing both sides of said film longitudinally with each other and both ends thereof laterally, wherein both sides of the film are turned outside to form two rows or turned-up faces, a turned-up line formed by said two rows of turned-up faces is covered with an easily openable fusing tape having an easily openable film inside and reinforced with a base material outside, said tape being fused with the turned-up faces of the film, and at least one end of the fusing tape not fused by a length which can be taken with fingers is left as a pick-up flap in the laterally fused area. When cooked food for a few people is hermetically packaged in this sealed bag and heated with a microwave oven, the bag is not broken until the internal temperature thereof approaches 100° C. and is slightly opened when the inside thereof is sufficiently filled with water vapor, thereby discharging water vapor, and the separation of the tape after the completion of heating permits the contents to be easily taken out.

11 Claims, 3 Drawing Sheets

SEALED BAG FOR MICROWAVE HEATING

BACKGROUND OF THE INVENTION

The present invention relates to a sealed bag for heating food with a microwave oven, and more particularly, to a sealed bag for microwave heating in which the sealed state is maintained during distribution and storage thereof. The breakage thereof does not take place until the internal temperature thereof approaches 100° C. by microwave heating at that time, a central portion thereof is slightly opened in the state in which the inside thereof is sufficiently filled with water vapor, thereby discharging water vapor, and the separation of a tape after the completion of heating permits the contents to be removed.

BACKGROUND OF THE INVENTION

Previously, food has been packed in inner bags having ventilating perforations, and the inner bags have been sealed in outer bags to package cooked food for a few people. At the time of use, the inner bags are taken out of the outer bags, and then, heated in a microwave oven. In this case, the inner bags are heated on a tray, because the contents leak from the inner bags through the ventilating perforations.

There have also been sealed bags for microwave heating in which non-fused areas narrow in width are opened in longitudinally or laterally fused areas and water vapor is released through the non-fused areas in heating them.

Further, sealed bags for microwave heating have been known in which small perforations previously formed are covered with separative sheet pieces to keep the bags hermetic until heating. In this ease, the sheet pieces are separated just before heating in a microwave oven.

Commercial microwave ovens employ heating systems by use of microwaves, and particularly, heating is well performed through water. Food contains much water, and is heated from the inside thereof. The surface thereof is cooled and not elevated in high temperature because the latent heat of vaporization is carried away.

When the bag is sealed, the inside thereof is filled with water vapor and water is prevented from being evaporated from the surface thereof. The surface temperature is therefore elevated. In this method, however, the internal pressure is increased too high, resulting in abrupt breakage of the bag, namely breakage of the bag like an explosion. This method is therefore dangerous.

The present invention provide a technique for keeping a bag hermetic during distribution and storage thereof, maintaining the bag hermetic in early stages even in heating it with a microwave oven to sufficiently elevate the internal temperature, and naturally breaking the bag at a safe time.

SUMMARY OF THE INVENTION

According to the present invention, there is provided a sealed bag for microwave heating composed of a film having a fusing layer inside, said bag being sealed by fusing both sides of said film longitudinally with each other and both ends thereof laterally, in which both sides of the film are turned outside to form two rows of turned-up faces, a turned-up line formed by said two rows of turned-up faces is covered with an easily openable fusing tape having an easily openable film inside and reinforced with a base material outside, said tape being fused with the turned-up faces of the film, and at least one end of the fusing tape not fused by a length which can be taken with fingers is left as a pick-up flap in the laterally fused area. Further, the present invention is characterized in that the peel strength of the easily openable tape from the film of the bag is 100 g/15 mm to 1,500 g/15 mm, and that the easily openable fusing tape is fused with the respective turned-up faces over a width of 1 mm to 15 mm.

According to the present invention, the sealed state of the bag is maintained during distribution and storage thereof and until the sealed bag is filled with water vapor to inflate it like a balloon, even when heating it with a microwave oven. A part of the bag is gently opened to gradually release water vapor when the internal pressure reaches a specified value.

Accordingly, there is no fear of contaminating the contents during distribution and storage, and the bag is maintained in the sealed state in the early stages of heating, so that the inside of the bag is filled with heated water vapor. It becomes therefore possible to heat the contents to a fresh state as newly made food.

DETAILED DESCRIPTION OF THE INVENTION

Base films used in the sealed bags of the present invention are films of various plastics such as polypropylene, polyesters, polyethylene and nylon, laminated products thereof and products thereof laminated with aluminum evaporation layers, paper or polyvinylidene chloride layers. These base films have heat fusible layers inside with a low melting point, such as low-density polyethylene and ethylene-vinyl acetate copolymers. When the base films are films which are heat fusible themselves, such as polyethylene films and polypropylene films, they may be monolayer films having no additional heat fusible layers.

The longitudinally fused area used in the present invention is a fused area formed in a longitudinal direction of the film forming the bag, and the laterally fused area is a fused area formed in a lateral direction of the film forming the bag, independently of the ratio of lengths of the completed bag.

In the present invention, easily openable fusing films generally used uncovers in tops of containers for jellies and yogurt are employed as the fusing tapes. The easily openable films are widely commercially available, and include VMX 22RX manufactured by Mitsubishi Chemical Corporation, CMPS 017C manufactured by Tosero Co. Ltd. and TAF 610C manufactured by Tosero Co. Ltd.

The easily openable fusing films are used by backing them with films of polyesters, nylon, polypropylene and the like, and cutting them to the form of the fusing tape. The easily openable fusing films may be backed after cutting to the tape form.

Figure 1:
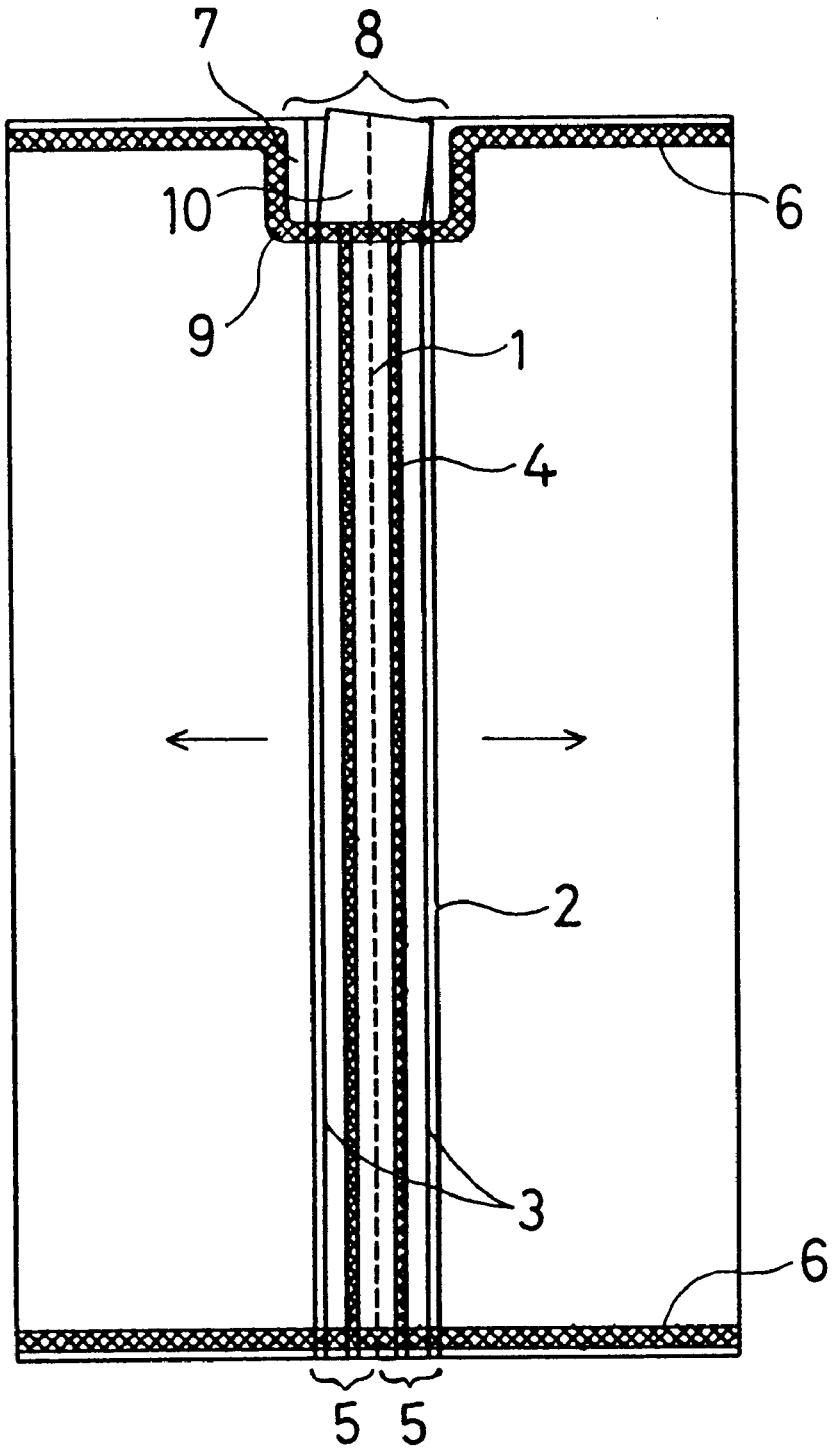
FIG. 1 is a plan view showing a sealed bag having a longitudinally fused area embodying the present invention.
Figure 4:
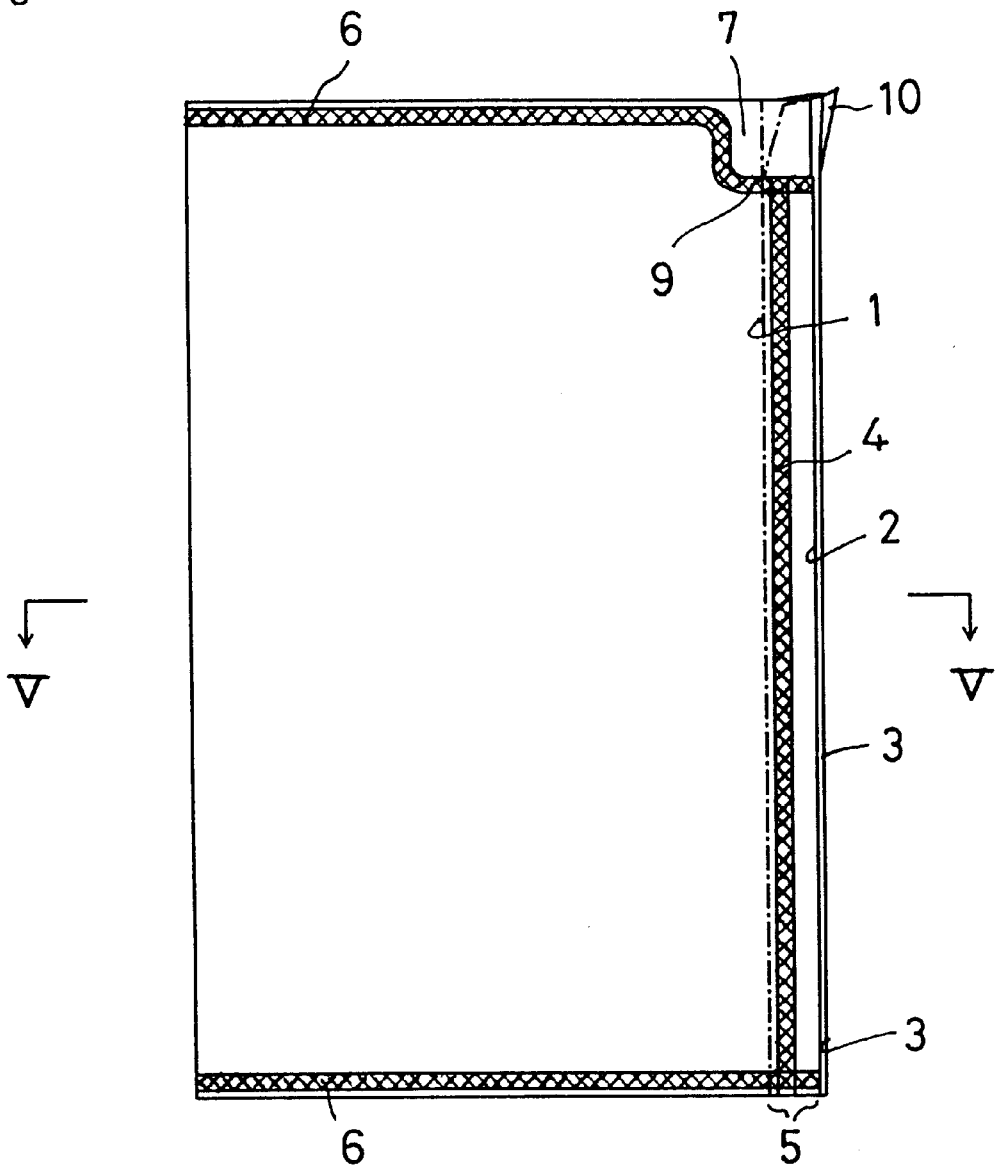
FIG. 4 is a plan view showing another embodiment of a sealed bag having a longitudinally fused area embodying the present invention.
Figure 5:
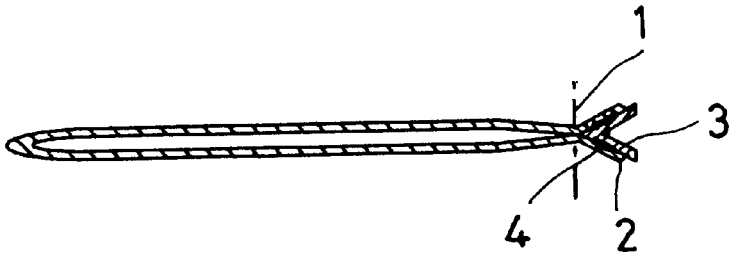
FIGS. 5 is a cross sectional view taken along the line V—V of FIG. 4.

The bag is in the so-called pillow form in which one longitudinally fused area is formed on one face of the bag. The longitudinally fused area may be formed in a central portion on one face of the bag as shown in FIG. 1 or shifted to an edge on one face of the bag. Further, a gusset type bag having gusset folds on both edges can also be used. In this case, the bag can be filled with the contents in large. As shown in FIG. 4 and FIG. 5, it is also possible to form one longitudinally fused area in one side portion of the bag. When the longitudinally fused area is formed in the side portion, the internal temperature is higher when heating than when the area is formed in one face of the bag.

Prior to the preparation of the sealed bag of the present invention, both longitudinal side edges of the raw material film are brought together in a cylindrical form, and folded back over to form turned-up faces. As shown in FIG. 1, both edges of the turned-up face are a turned-up line 1 which is a fold line, and a side edge line 2 of the turned-up face which is a cut line of the film. The width of the turned-up face is preferably 5 mm to 20 mm.

Two turned-up lines 1 are preferably in contact with each other. However, they are not necessarily in contact with each other. Some clearance between them or some overlapping of them may be allowed, as long as they do not come in contact with a longitudinally fused area 4 described later. A fusing tape 3 of the present invention is fused on top of the two turned-up faces. As the fusing tape 3, an easily openable tape having a peel strength of 100 g/15 mm to 1,500 g/15 mm, preferably 200 g/15 mm to 1,000 g/15 mm, is used. Even when a fusing tape 3 having a low peel strength is used, an increase the width of the bag when is fused in it being difficult to open the bag by hand. The fused width is preferably 1 mm to 15 mm, and more preferably 2 mm to 10 mm, per one turned-up face. The reference numeral 4 designates the longitudinally fused area, and the reference numeral 5 designates the turned-up faces.

Laterally fused areas 6 are formed in both end portions, crossing at right angles to the longitudinally fused area of the bag. The inside of the tape is fused with the turned-up faces of the film, leaving a portion 7 which is not fused and is of a length easily grasped with fingers, namely 6 mm to 15 mm, as a pick-up flap positioned at a least one laterally fused area. The portion 7, which is not fused may be formed on the whole surface of the laterally fused area. However, when the portion 7, which is not fused is under, it results in the use of the film in large amounts, and causes the disadvantage that the Actual bag volume is decreased, though the apparent bag volume is seemingly increased.

Then, as shown in FIG. 1, an opening portion 8 having a width larger than the tape is formed, and the laterally fused area is curved in the opening portion 8. The wide portion 7 is not fused, but an inner laterally fused area 9 which is formed by the curve in the opening portion 8 is fused.

Accordingly, the laterally fused area is continously sealed while forming the portion 7, which is not fused. However, it is curved in the form of a "U".

The wide opening portion 8 is outside the inner laterally fused area 9, and the fusing tape 3 is not fused in this site and, instead, forms a pick-up flap 10.

In some cases, even when both extended portions of the inner laterally fused area 9 are linearly fused and areas between the laterally fused area 6 and extended fused portions are widely fused, a similar effect is obtained.

Further, both of the laterally fused areas can also be provided with the pick-up flaps 10.

The pick-up flap 10 has a length of 6 mm to 15 mm, so that it can be easily grasped by the fingers. When the pick-up flap 10 is grasped by the fingers and pulled, one side of the bag can be opened all at once and the contents can be easily discharged from the bag.

In making the bags, a continuous bag making and filling method can be employed. After longitudinal fusing and filling of the contents, lateral fusing and cutting are performed at the same time, thereby continuously producing the sealed bags, which can be distributed,and stored without fear that the contents will leak or the the bag will break.

In the present invention, not only the sealing property, but also the easy openability of the bag is important. The bag is required to be opened by grasping the pick-up flap with fingers and pulling it. Even when an easily openable film is used, overall fusing impairs the easy openability. In general, the width of a heat bar used for fusing is 1 mm to 15 mm, and preferably 2 mm to 10 mm.

When one longitudinally fused area is formed in one side portion of the bag, as shown in FIG. 4, the longitudinally fused area is formed as follows. The film used to make the bag is folded along center line and the both side edge lines 2 are mated so that they seem to be one line. A fusing tape 3 is folded along the center line facing the fusing layer outside. The folded fusing tape 3 is inserted between the folded side edge lines 2, leaving the both edges of the folded fusing tape 3 slightly. Then, longitudinally fused area 4 is formed by fusing between turned-up line 1 and side edge line 2. And finally laterally fused areas are fused in the same way as described in the bags of FIG. 1.

The two turned-up faces 5 are overlapped and laterally fused in thus produced bag. Generally, an outer surface material of a fusing tape 3 is not heat fusible, so that the turned-up faces 5 are not fused with each other. A main body of the bag and two turned-up faces 5 form a Y, centered on the turned-up lines 1, in a cross sectional view of the bag, and the fusing tape 3 is fused on the forked turned-up faces in the V form to form a longitudinally fused area 4. In this case, almost all of the fusing tape 3 is not exposed, so that there is no fear of separation of the fusing tape by rubbing during distribution. Further, the appearance of the bag itself is also improved.

Even such a bag is broken at the longitudinally fused area when the internal pressure is sufficiently increased by heating it in a microwave oven. When a large amount of liquid is not contained in the contents, the sealed bag of this type can also be used.

At the time of use, the bag is placed in a microwave oven, with the face having the longitudinal fused area facing upward, and heated by the ordinary heating method. In the microwave oven, food is heated from a center portion thereof, and when a surface portion thereof is heated, water vapor is produced to inflate the bag like a balloon. When the bag is sufficiently inflated, a central portion of the fusing tape 3 is separated producing a faint explosive sound to break the bag. Then, water vapor is appropriately discharged through the broken portion of a lower face of the tape, and the inside thereof is sufficiently heated. After the completion of heating, the pick-up flap 10 is pulled to separate the fusing tape 3 all at once, thereby enabling the bag to be widely opened.

In the sealed bag of the present invention, end portions of the film are turned outside in the longitudinally fused area to form the turned-up faces, and the tape having a relatively low separation strength is narrowly fused on the turned-up faces. According to this sealing method, the bag can be maintained sufficiently hermetic during distribution and storage. When the bag is heated in a microwave oven as such, the inside thereof is filled with water vapor because of its hermetic sealing. Accordingly, the latent heat of vaporization is not carried away from the surface of the food, resulting in an increase in internal temperature to 98 to 99° C. or more, and an increase in internal pressure at the same time.

On the other hand, in the sealed bag of the present invention in which one longitudinally fused area is formed in one side portion thereof, both end portions of the film are turned outside to form the turned-up faces, and the tape having a relatively low separation strength is narrowly fused on the turned-up faces.

Accordingly, when the internal pressure is increased, the power of widening the inner diameter of the bag is applied to the bag. In the present invention, the end portions of the film are turned outside in the longitudinally fused area. The bag is therefore widened so as to narrow the turned-up faces. Further, the fused face is separated because of its low separation strength, finally leading to development of an opening. A site most liable to receive the internal pressure is generally the central portion of the bag, so that the central portion is broken to discharge water vapor. However, the other sites are fused, and the opening is also covered with the tape. Accordingly, water vapor is appropriately discharged, and the surface temperature is not lowered so much.

That is, the bag of the present invention is maintained sufficiently hermetic during distribution and storage and in early stages of heating with a microwave oven, and a part of the bag is only gently broken when the internal pressure reaches a specified value.

EXAMPLE 1

A sealed bag for a microwave oven of the present invention having the shape shown in FIG. 1 was produced. Both sides of a 30 cm-wide film were each turned outside by 1 cm to form turned-up faces 5. Respective turned-up lines 1 were allowed to approach to each other, and a fusing tape was fused on both the turned-up faces 5, thereby turning the film to the cylindrical form. In longitudinal fusing, a roughly central portion of each turned-up face 5 was heated with a heat bar having a width of 3 mm.

One end of this cylindrical film is linearly laterally fused leaving a slight portion not fused outside, and the other end was fused by a laterally fused area 6 curved in the U form so as to leave an opening portion 8. The opening portion 8 was formed in a position in which it was not in contact with a fusing tape 3. Accordingly, a pick-up flap 10 was in a separated state. Concurrently with lateral fusing, the bag was cut to a length of 22 cm, and filled with two small-sized Chinese buns 11. When the bag was heated in a microwave oven, either one of the sites indicated by the arrows in FIG. 1 was opened.

In this example, the longitudinally fused area was formed in a central portion on one face of the bag, and a material in which an inner surface of a 15 μm-thick nylon film dry laminated with a 50 μm-thick linear low-density polyethylene film was used as a material for the bag. A 18 mm-wide fusing tape in which an inner surface of a 16 μm-thick polyester film was laminated with a 50 μm-thick easily openable film was used as the fusing tape 3. As the easily openable film, CMPS 017C manufactured by Tosero Co. Ltd. was used.

Figure 2:
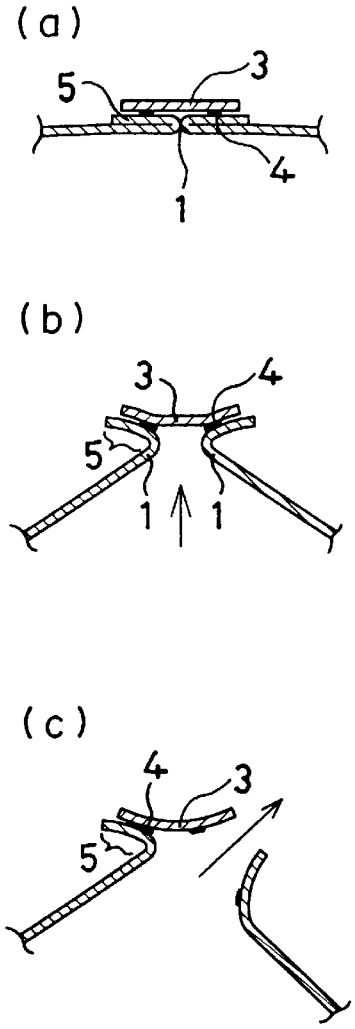
FIGS. 2(*a*) to 2(*c*) are cross sectional views showing the longitudinally fused area, wherein 2(*a*) shows a state in which no internal pressure is applied, 2(*b*) shows a state in which an internal pressure is applied and the width of turned-up faces is narrowed, and 2(*c*) shows a state in which the bag is broken at the left in the drawing.
Figure 3:
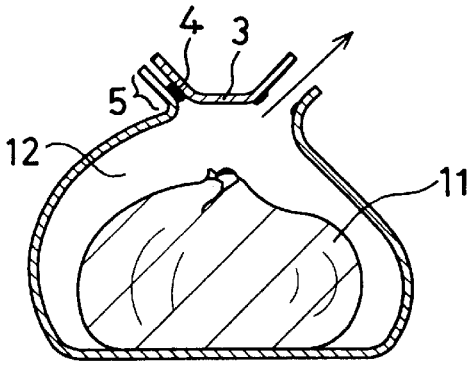
FIG. 3 is a cross sectional view of the bag showing a state in which the bag is still heated after the breakage at the central portion thereof.

When heated in a microwave oven, the bag was kept for a while in the state shown in FIG. 2(*a*). However, the bag began to inflate gradually to narrow the width of the turned-up faces as shown in FIG. 2(*b*). When inflated like a fully inflated balloon, the bag was broken at one of the fused areas 6 as shown in FIG. 2(*c*), and the discharge of water vapor started. However, the discharge of water vapor was not so violent that the bag was kept inflated as shown in FIG. 3., because the tape was present on the opening portion as before. The reference numeral 12 designates the water vaper filled in the bag.

After the completion of heating, the bag could be easily opened by taking the pick-up flap 10 with fingers and pulling it. Further, the peel strength of the fusing tape was decreased by heating, so that the whole bag could be opened only by pulling the broken site. Chinese buns do not contain much water and crumble when heated in a microwave oven. However, when the Chinese buns 11 sealed in the bag of the present invention were heated, water was sufficiently supplied to the whole to provide wet ones similarly to the case that they were heated by use of a steamer. The reference numeral 12 designates water vapor.

Frozen food and chilled food which can be eaten as such by microwave oven heating can be packaged in the bag of the present invention. Examples of such food include hamburgers, prawn chili sauce, sweet-and-sour pork, meat dumplings, various cooked foods, shao-mais, omelets, spaghetti, pilaf, various lunches and dried fishes, as well as Chinese buns.

When the contents are taken out of the bag without use of a microwave oven, the bag is easily opened by pulling the pick-up flap 10 as such.

EXAMPLE 2

Using the same film and fusing tape 3 as with Example 1, two kinds of sealed bags for a microwave oven having a width of 167 mm, a length of 237 mm and a maximum volume of 1100 ml were produced in the same manner as with Example 1. One had the shape shown in FIG. 1 in which a longitudinally fused area was formed in a central portion of the bag, and the other had the shape shown in FIG. 4 in which a longitudinally fused area was formed in a side portion of the bag. Each bag was filled with 300 ml of water and sealed. The sealed bags were heated in a microwave oven, and the time from the start of heating to the breakage of the bags and the temperature on the breakage of the bags were measured. The measurements were repeated 5 times and the mean values thereof were determined for each bag.

For the bag having the shape shown in FIG. 1 in which the longitudinally formed area was formed in the central portion, the time until the breakage of the bag was 3.59 seconds, and the internal temperature was 98.9° C. On the other hand, for the bag having the shape shown in FIG. 4 in which the longitudinally fused area was formed in the side portion, time until the breakage of the bag was 4.06 seconds, and the internal temperature was 99.3° C.

What is claimed is:

1. A method of microwave heating food comprising:

exposing a sealed bag, containing food, to microwaves for generating water vapor;

the sealed bag being formed from a film having a fusing layer on at least one surface thereof; the film having first and second longitudinal edges opposite one another and first and second lateral edges opposite one another; the film having first and second folded longitudinal edges being formed by respectively folding the first and second longitudinal edges to expose the same surface of the film having the fusing layer thereon; a first turned-up face of the film defined by the first longitudinal edge and the first folded longitudinal edge;

a second turned-up face of the film defined by the second longitudinal edge and the second folded longitudinal edge; the first and second folded longitudinal edges being adjacent one another to form an adjacent area in which the first and second folded longitudinal edges are adjacent; a fusing tape covering at least a portion of the first and second turned-up faces of the film; a fused portion, in which the fusing tape is fused to the first and second turned-up faces of the film, being inward of the first and second longitudinal edges, respectively, whereby the first and second folded longitudinal edges are not fused to the fusing tape; the fused portion operating to seal the bag in a longitudinal direction; a seal also being formed at the first and second lateral edges, respectively, to completely seal the bag; and maintaining the exposing of the bag to microwaves until an internal temperature of the bag reaches about 100° C. thereby breaking at least a portion of the seal of the bag in the longitudinal direction and gradually discharging water vapor.

2. A sealed bag for microwave heating comprising:

a film having a fusing layer on at least one surface thereof, the film having first and second longitudinal edges opposite one another and first and second lateral edges opposite one another, the film having first and second folded longitudinal edges being formed by respectively folding the first and second longitudinal edges to expose the same surface of the film having the fusing layer thereon;

a first turned-up face of the film defined by the first longitudinal edge and the first folded longitudinal edge;

a second turned-up face of the film defined by the second longitudinal edge and the second folded longitudinal edge;

the first and second folded longitudinal edges being adjacent one another;

a fusing tape covering at least a portion of the first and second turned-up faces of the film;

a fused portion, in which the fusing tape is fused to the first and second turned-up faces of the film, being inward of the first and second longitudinal edges, respectively, whereby the first and second folded longitudinal edges are not fused to the fusing tape, the fused portion operating to seal the bag in a longitudinal direction;

a seal also being formed at the first and second lateral edges, respectively, to completely seal the bag.

3. A sealed bag as claimed in claim 2, wherein the fusing tape has a peel strength from the film of the bag of 100 g/15 mm to 1,500 g/15 mm.

4. A sealed bag as claimed in claim 3, wherein the fusing tape has a peel strength from the film of the bag of 200 g/15 mm to 1,000 g/15 mm.

5. A sealed bag as claimed in claim 2, in which the first and second folded longitudinal edges are in contact with one another.

6. A sealed bag as claimed in claim 2, in which the first and second folded longitudinal edges are not in contact with one another.

7. A sealed bag as claimed in claim 2, in which the seal formed at the first and/or second lateral edge of the sealed bag is distal the first and/or second lateral edge of the sealed bag in an area of the sealed bag including the first and second turned-up face of the film and the fusing tape, whereby a portion of the fusing tape about 6 mm to 15 mm long is not fused to the bag, and the seal formed at the first and/or second lateral edge of the sealed bag is proximate the first and/or second lateral edge of the sealed bag in an area of the sealed bag not including the first and second turned-up face of the film and the fusing tape.

8. A sealed bag as claimed in claim 2, in which the bag has a central portion and a side portion and the first and second longitudinal edges are in the central portion of the bag.

9. A sealed bag as claimed in claim 2, in which the bag has a central portion and a side portion and the first and second longitudinal edges are in the side portion of the bag.

10. A sealed bag as claimed in claim 2, in which the fused portion on the first and second turned-up faces of the film, respectively, is about 1 to 15 mm wide.

11. A sealed bag as claimed in claim 2, in which the first and second turned-up faces of the film, respectively, are about 5 mm to about 20 mm wide.

* * * * *